US006042224A

United States Patent [19]

Oda et al.

[11] Patent Number: 6,042,224

[45] Date of Patent: Mar. 28, 2000

[54] IMAGE RECORDING DEVICE

[75] Inventors: Kazuyuki Oda; Harumi Tamura; Katsuyuki Fujii; Ichiro Tomikawa, all of Ebina, Japan

[73] Assignee: Fuji Xerox Co., Ltd., Tokyo, Japan

[21] Appl. No.: 08/977,805

[22] Filed: Nov. 25, 1997

Related U.S. Application Data

[63] Continuation-in-part of application No. 08/601,522, Feb. 14, 1996, Pat. No. 5,821,965.

[30] Foreign Application Priority Data

Nov. 28, 1996 [JP] Japan ..... 8-318015

[51] Int. Cl.[7] ..... B41J 2/175

[52] U.S. Cl. ..... 347/86

[58] Field of Search ..... 347/85, 86, 87

[56] References Cited

U.S. PATENT DOCUMENTS

| | | | |
|---|---|---|---|
| 5,589,862 | 12/1996 | Ujita et al. | 347/87 |
| 5,760,806 | 6/1998 | Oda et al. | 347/87 |
| 5,886,721 | 3/1999 | Fujii et al. | 347/87 |

FOREIGN PATENT DOCUMENTS

| | | |
|---|---|---|
| 6-71900 | 3/1994 | Japan . |
| 8-207298 | 8/1996 | Japan . |
| 8-224884 | 9/1996 | Japan . |

*Primary Examiner*—N. Le
*Assistant Examiner*—Michael Nghiem
*Attorney, Agent, or Firm*—Oliff & Berridge, PLC

[57] ABSTRACT

An ink tank 1 includes a main ink chamber 11 and a intermediate chamber 16. A second meniscus forming member 17 is provided in a joint portion 2 to be coupled with a printhead 3. A filter 22 is provided in an ink introducing portion 4 of the printhead 3, which is to be coupled with the ink tank 1. The open-space diameter of the second meniscus forming member 17 is selected to be equal to that of the filter 22. With such a construction, the number of foreign materials flowing from the ink tank 1 to the filter 22 is reduced. The result is to reduce a frequency of occurrence of the filter clogging and to elongate a normally operable time of the printer. A fluid resistance in the ink passage ranging from the filter 22 to the nozzle is high. Therefore, air that is left in the jointing portion flows through the second meniscus forming member 17 into the intermediate chamber 16 of the ink tank 1. Therefore, there is eliminated such an unwanted situation that air bubbles enter the printhead and given rise to defects in a printed picture.

4 Claims, 6 Drawing Sheets

| FILTER TYPE | 10μm | 20μm | 30μm | 40μm |
|---|---|---|---|---|
| MAT FIGURED CLOTH FILTER 12μm | 55% | 10% | 3% | 0% |
| MAT FIGURED CLOTH FILTER 13μm | 71% | 42% | 15% | 2% |
| MAT FIGURED CLOTH FILTER 38μm | 96% | 80% | 63% | 50% |
| FOREIGN MATERIALS PASSING RATIO (MAT FIGURED CLOTH FILTER 12μm / MAT FIGURED CLOTH FILTER 38μm) | 57% | 13% | 5% | 0% |
| FOREIGN MATERIALS PASSING RATIO (MAT FIGURED CLOTH FILTER 13μm / MAT FIGURED CLOTH FILTER 38μm) | 74% | 53% | 24% | 4% |

A

| B | | C | | | |
|---|---|---|---|---|---|
| D | E | F | G | H | I |
| J38 | J12 | 400 | 14000 | 12000 | × |
| J32 | | 430 | 15050 | 12900 | × |
| J22 | | 500 | 17500 | 15000 | × |
| J20 | | 540 | 18900 | 16200 | × |
| J16 | | 600 | 21000 | 18000 | △ |
| J15 | | 650 | 22750 | 19500 | △ |
| J14 | | 690 | 24150 | 20700 | ○ |
| J13 | | 750 | 26250 | 22500 | ○ |
| J12 | | 800 | 28000 | 24000 | ◎ |
| J13 | J5 | 200 | 7000 | 6000 | × |
| J12 | | 600 | 21000 | 18000 | △ |
| J5 | | 800 | 28000 | 24000 | ◎ |
| J4.5 | | 1000 | 35000 | 30000 | ◎ |
| J12 | J4.5 | 350 | 12250 | 10500 | × |
| J5 | | 600 | 21000 | 18000 | △ |
| J4.5 | | 800 | 28000 | 24000 | ◎ |
| J4.0 | | 900 | 31500 | 27000 | ◎ |
| J5 | J4.0 | 400 | 14000 | 12000 | × |
| J4.5 | | 600 | 21000 | 18000 | △ |
| J4.0 | | 700 | 24500 | 21000 | ○ |

A: AMOUNT OF USED INK AND LIFETIME JUDGEMENT ACCORDING TO FILTER TYPE

B: CONSTRUCTION OF FILTER TYPE

C: RESULTS OF EVALUATION

D: A SECOND MENISCUS FORMING MEMBER (INK TANK IS COUPLED)

E: FILTER (IS COUPLED WITH A PRINTHEAD)

F: AMOUNT OF USED INK IN LIMIT RESISTANCE VALUE IN THE PRINTER (ml)

G: LIFETIME NUMBER OF PRINTING SHEETS 400 dpi

H: LIFETIME NUMBER OF PRINTING SHEETS 400 x 800 dpi

I: JUDGEMENT

J: MAT FIGURED CLOTH FILTER

*FIG. 9*

IMAGE RECORDING DEVICE

This application is a Continuation-In-Part of application Ser. No. 08/601,522, filed Feb. 14, 1996, now U.S. Pat. No. 5,821,965.

BACKGROUND OF THE INVENTION

The present invention relates to an image recording device of the ink jet type which ejects ink drops through the nozzles thereof to record an image on a recording medium.

An image recording device of the type in which the ink tank for supplying ink to the recording head or printhead thereof is detachably attached to the recording device per se has been developed and is currently marketed. In this type of the image recording device, only the replacement of the ink tank with a new one suffices for the ink supply to the printhead. This ink tank may be manufactured at low cost. The result is the reduction of the running cost of the recording device.

In this ink supplying system using the detachable type ink tank in the image recording device, a filter for preventing the ink leakage in used in the part of the ink tank in the jointing portion between the ink tank and the printhead. Another filter is also provided in the part of the printhead in the jointing portion. The filter prevents dust particles and the like from entering the printhead when the ink tank is removed from the printhead.

In an image recording device disclosed in the Unexamined Japanese Patent Application Publication No. Hei. 6-71900, a first filter is provided at the ink inlet of the printhead, and a second filter is provided at the ink supplying port of the ink tank. The mesh size of the first filter is selected to be larger than that of the second filter. With the construction, when the ink tank is attached to the printhead, air bubbles left in the ink passage are led to the printhead, whereby the flow of air bubbles into the ink tank is checked. The air bubbles are sucked out of the printhead through the nozzle by the ink suction in a maintenance, for example. Sometimes, the air bubbles are still left in the printhead. In this case, the air bubbles are present in the ink passage, possibly causing improper discharging of ink. The improper ink discharging gives rise to a picture defect of the printed picture.

Another image recording device is disclosed in the Unexamined Japanese Patent Application Publication Nos. Hei. 8-224884 and Hei. 8-207298. In each publication, the ink supplying system guides to the ink tank air bubbles that Are left in the ink passage after the ink tank is attached to the printhead while checking the flowing of air bubbles to the printhead. Thus, in those publications, the destination of the residual air bubbles is the ink tank while it is the printhead in the publication already referred to, the Unexamined Japanese Patent Application Publication No. Hei. 6-71900. So far as we read, there is no description on the conditions of the filters. In the ink supplying system of each of the recording devices of those publications, i.e., the Unexamined Japanese Patent Application Publication Nos. Hei. 8-224824 and Hei. 8-207298, if the mesh size of the filter placed at the ink inlet of the printhead is smaller than that of the filter at the ink supplying port of the ink tank, the air bubbles left In the jointing portion must move to the ink tank. Therefore, the air bubbles entering the printhead is considerably reduced in amount, so that a frequency of the occurrence of the improper discharging of ink, which is due to the air bubbles, is reduced.

Thus, those filters have functions to remove foreign material from the ink in the ink tank and to check the entering of foreign materials into the printhead. FIG. 7 is a table showing, by way of example, relationships between filtering particle sizes and particle passing efficiencies of filters. In the table of FIG. 7, mat figured cloth filters of different mesh sizes are shown. The mesh sizes of those filters are 12 $\mu$m, 13 $\mu$m and 30 $\mu$m. Foreign materials of different particle sizes are used. The particle sizes of the foreign materials are 10 $\mu$m, 20 $\mu$m, 30 $\mu$m and 40 $\mu$m. The table describes those foreign materials that passed through those filters in terms of %. The mat figured cloth filter of 12 $\mu$m in mesh size substantially rejects the passing of foreign materials of 40 $\mu$m particle size. The remaining foreign materials of 20 $\mu$m, 30 $\mu$m, 40 $\mu$m, which passed through the filter are: 55%, 10% and 3%. The foreign materials of 10 $\mu$m, 20 $\mu$m, 30 $\mu$m, 40 $\mu$m, which passed through the mat figured cloth filter of 38 $\mu$m in mesh size, are 96%, 80%, 63% and 50%. As seen from the table, if highly precise filters of small mesh size are used, it is possible to increase the efficiency of arresting foreign materials contained in the ink within the ink tank and to reduce the number of foreign materials in the ink supplied to the printhead. The result in to reduce a frequency of the occurrence of the improper ink discharging, which is caused by foreign materials, e.g., dust particles, and hence to stably record a quality picture on the recording medium, e.g., a printing paper.

In the ink supplying system of the type in which foreign materials are arrested by use of the filters, the mesh of the filter is frequently clogged with foreign materials when the recording device or printer is used for a long time. Particularly where the filter of a small mesh size is used in the part of the printhead as in the above case, fine foreign materials pass through the filter in the part of the ink tank, and are arrested by the filter in the part of the printhead. Therefore, the filter of the print head tend to be clogged with the foreign materials. The filter clogging leads to an increase of a fluid resistance of the filter. If the printer whose fluid resistance is high is operated for a high density printing, an insufficient amount of ink is supplied to the printhead, and air is sucked through the nozzles of the printhead. The resultant picture printed on the printing paper suffers from a picture defect, e.g., bleaching.

FIG. 8 is a graph showing a variation of fluid resistance of a filter against the amount of used ink. For a measurement to gather data depicting the graph, a mat figured cloth filter of 12 $\mu$m in mesh size was used in the part of the printhead, and a mat figured cloth filter of 38 $\mu$m in mesh site was used in the part of the ink tank. Here, a fluid resistance is defined as $R(Pa\cdot sec/m^3)$ when $P(Pa)=RQ(m^3/sec)$. A viscosity of ink used for the measurement was $2.0\times10^{-3}$ Pa·sec.

A seen from FIG. 8, a fluid resistance of the filter exceeds a limit resistance value within which a normal printing is possible. Thus, even if the printhead of long lifetime, is used, the printer is unusable because of the filter clogging.

SUMMARY OF THE INVENTION

For the above background reasons, an object of the present invention is to provide an image recording device which can be unable for a long time.

Aspect 1 sets for an image recording device of the type in which ink is supplied from an ink tank to a printhead, and the printhead ejects the received ink in the form of ink drops through nozzles thereof onto a recording medium, to thereby form an image on the recording medium, the improvement being characterized in that the ink tank comprising:

a first ink chamber for holding ink therein under a negative pressure, the first ink chamber including an air inlet opened to the air and an ink supplying port for supplying ink;

a first meniscus forming member having a number of perforations, provided in the ink supplying port;

a second ink chamber being communicatively continuous to the ink supplying port and having a joint portion to be communicatively coupled with the printhead; and a second meniscus forming member having a number of perforations, provided in the joint portion; and the printhead comprising:

a filter for filtering out incoming foreign materials when the filter is coupled with the joint portion of the ink tank;

wherein the open-space diameter of the second meniscus forming member in the ink tank is substantially equal to that of the filter in the printhead.

Aspect 2 specifies the image recording device of aspect 1 such that a fluid resistance of the ink passage ranging from the filter to the nozzles is higher than that of the ink passage ranging from the second meniscus forming member to the air inlet.

Aspect 3 specifies the image recording device of aspect 2 such that the ink tank is attachable and detachable, and air that is left and compressed between the second meniscus forming member when the ink tank is coupled with the printhead, is led to the second ink chamber of the ink tank by way of the second meniscus forming member.

Aspect 4 specifies the image recording device of aspect 3 such that the second ink chamber includes the upper surface slanted upward along which the residual air moves upward in the second ink chamber.

Aspect 5 specifies the image recording device of aspect 1 such that the open-space diameter of the filter is shorter than the diameter of each nozzle.

Aspect 6 specifies the image recording device of aspect 1 such that the filter is formed with a mat figured cloth of which the open-space diameter in approximately 12 $\mu$m.

Aspect 7 specifies the image recording device of aspect 1 such that the second meniscus forming member is a mat figured cloth filter of SUS.

BRIEF DESCRIPTION OF THE DRAWINGS

FIG. 9 is a result of the measurement and evaluation regarding the amount of used ink and lifetime.

DETAILED DESCRIPTION OF THE PREFERRED EMBODIMENTS

Figure 1:
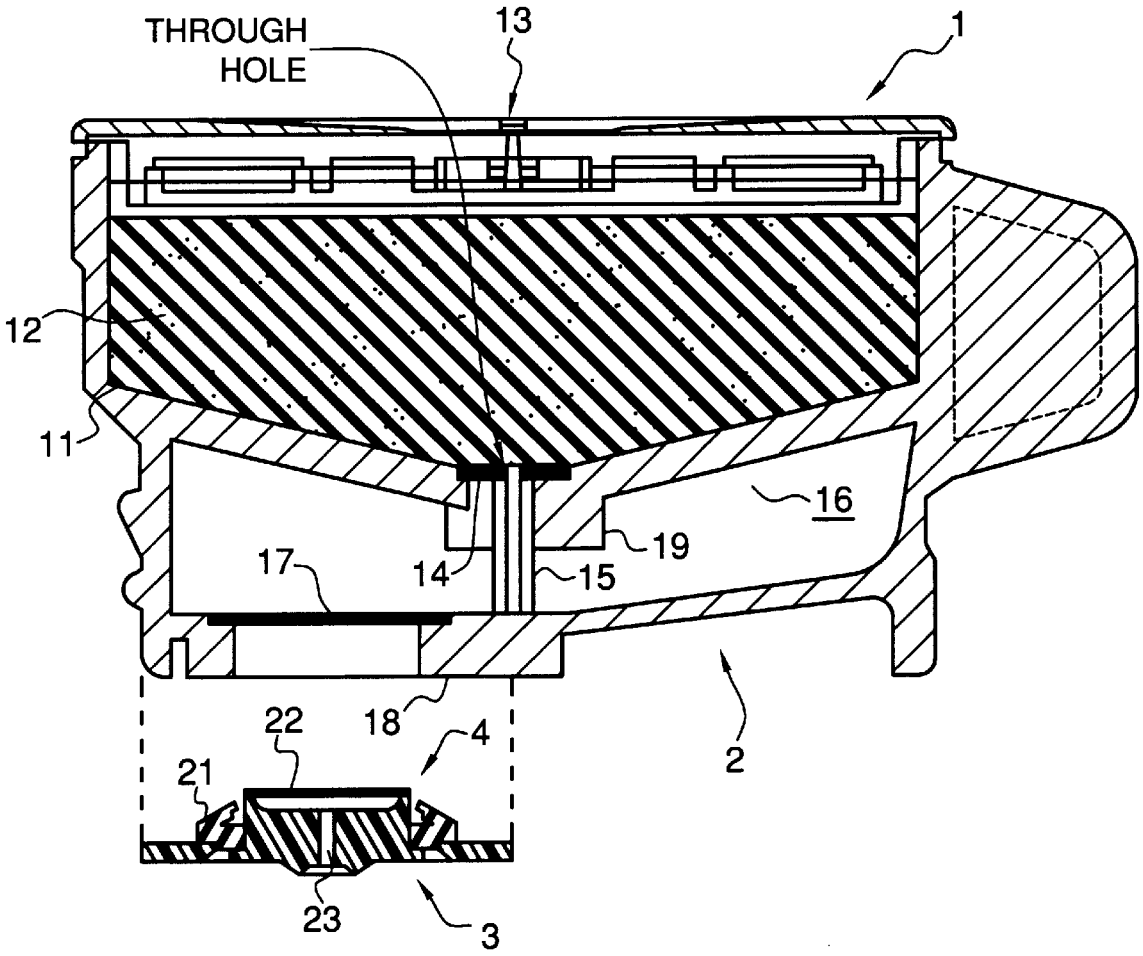
FIG. 1 is a cross sectional view showing a major portion of an ink jet printer which is an embodiment of the present invention.
Figure 2A:
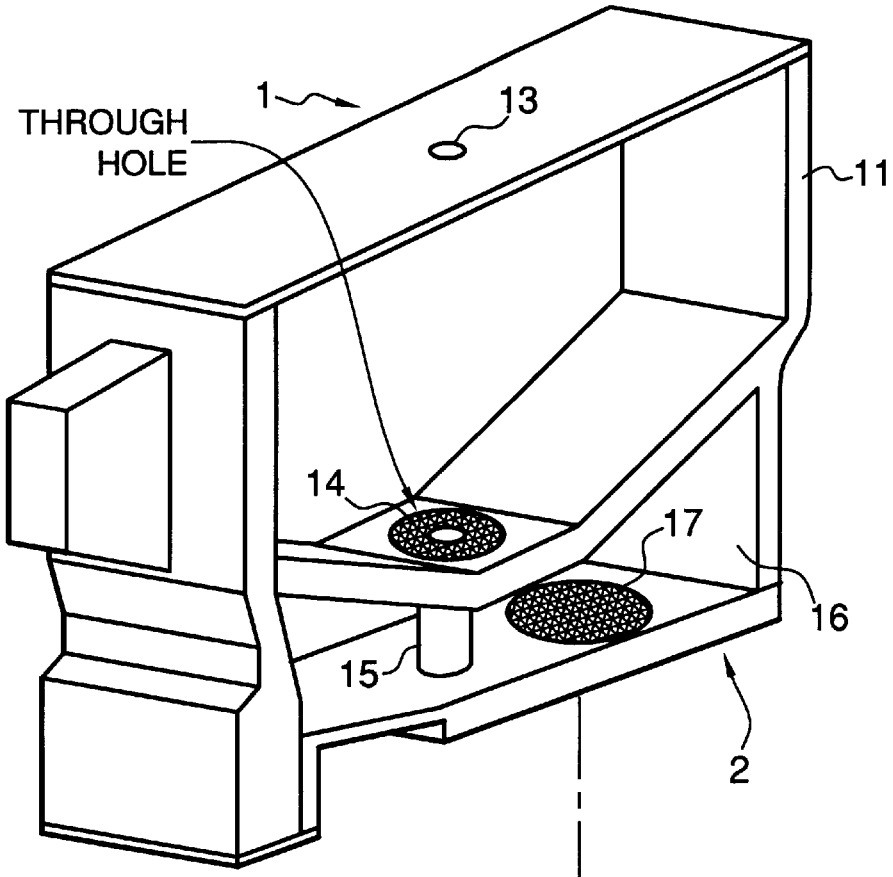
FIGS. 2A and 2B are perspective views showing a major portion of the ink jet printer shown in FIG. 1.
Figure 2B:
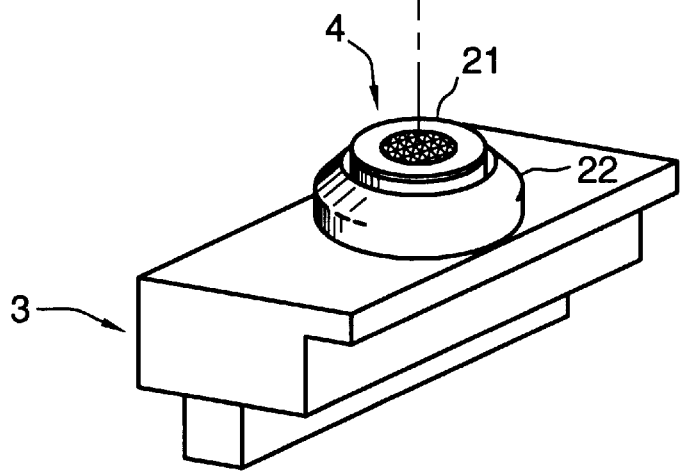

FIG. 1 is a cross sectional view showing a major portion of an ink jet printer which is an embodiment of the present invention. FIG. 2 is a perspective view showing a major portion of the ink jet printer shown in FIG. 1. In those figures, 1 is an ink tank; 2 is a joint portion; 3 is a printhead; 4 is an ink introducing portion; 11 is a main ink chamber; 12 is a capillary member; 13 is an air inlet; 14 is a first meniscus forming member; 15 is an ink introducing member; 16 is an intermediate chamber; 17 is a second meniscus forming member; 18 is an outer circumferential surface; 19 is an ink introducer holder; 21 is a joint member; 22 is a filter; and 23 is an ink passage. In FIGS. 1 and 2, there are illustrated the major portion of the ink jet printer before the ink tank 1 is attached to the printer, more exactly the printhead. In those figures, the printhead 3 is mounted on the printer, and a construction where the ink tank 1 is attached to the printhead 3 is illustrated, and only the portion of the fluid passage extending through the ink tank 1 and the printhead 3. In FIG. 2, one of the side walls of the ink tank 1 and the capillary member 12 are omitted. The ink tank 1 is coupled with the printhead 3 at the joint portion 2 of the ink tank. When the joint portion 2 of the ink tank 1 is brought into contact with the ink introducing portion 4 of the printhead 3, the ink passage becomes continuous which allows ink to be supplied from the ink tank 1 to the printhead.

The main ink chamber 11 and the intermediate chamber 16 located under the main ink chamber 11 are provided within the ink tank 1. The capillary member 12 is disposed within the ink tank 1. The capillary member 12 holds ink by its capillary force and is put under a negative pressure. The air inlet 13 is formed in the upper side of the main ink chamber 11, and allows the capillary member 12 to communicate with the air. A through-hole is formed in the lower side of the main ink chamber 11, and allows the main ink chamber to communicate with the intermediate chamber 16. The upper part of the capillary member 12 communicates with the air, via., it is opened to the air. Therefore, the ink in the capillary member 12 is pushed downward by the atmospheric pressure while being pulled downward by the negative pressure. The bottom surface of the main ink chamber 11 is sloped from the circumference to the center and the center of the bottom surface thereof is opened to form the through-hole.

The first meniscus forming chamber 14 having a great number of fine perforations is disposed within the through-hole of the bottom surface of the main ink chamber 11. The bottom of the capillary member 12 is pressed against the first meniscus forming member 14. When the capillary member 12 is impregnated with ink the ink moves through the first meniscus forming member 14 to the intermediate chamber 16. When the ink flows out of the capillary member 12 and no ink is present therein, air pushes the meniscuses within the perforations of the first meniscus forming member 14, and overcomes the surface tensions of the meniscuses and passes through the meniscuses and goes, in the form of air bubbles, into the intermediate chamber 16. Through this process, the ink supply pressure in the printhead 3 is kept at a pressure value below a predetermined one.

The Ink introducing member 15 is provided under the first meniscus forming member 14. The ink introducing member 15 is supported by the ink introducer holder 19 which extends downward (when viewed in the drawing) from the inner wall of the through-hole. Alternatively, a part of the first meniscus forming member 14 may be used as the ink introducing member 15. The ink introducing member 15 extends up to the bottom surface of the intermediate chamber 16. When air bubbles stay and an air layer is formed under the first meniscus forming member 14 or when the ink level descends within the intermediate chamber 16, the ink introducing member 15 sucks up the ink from the intermediate chamber 16 and supplies it to the first meniscus forming member 14. The result is that the first meniscus forming member 14 is kept wet and at a negative pressure. Further, the best ink supplying pressure is maintained.

A portion of the intermediate chamber 16 is higher than the through-hole. To be more specific, as shown in FIG. 1, the upper wall of the intermediate chamber 16 is slanted upward (when viewed in the drawing) so that the upper peripheral portion thereof is higher than the through-hole formed in the central part of the bottom of the main ink chamber 11. In the intermediate chamber 16, air bubbles that come in through the first meniscus forming member 14 and the second meniscus forming member 17 are introduced into the portion thereof higher than the through-hole, whereby the movement of the air bubbles from the joint portion 2 to the printhead 3 is blocked and hence no air bubbles stay in the jointing portion.

The joint portion 2 is provided in the bottom of the intermediate chamber 16 in order to mechanically and communicatively couple the intermediate chamber 16 with the printhead 3. The second meniscus forming member 17 is provided in the joint portion 2. The second meniscus forming member 17 has a great number of perforations, which serves as a filter of the ink tank 1. In a state that the ink tank 1 is detached from the printer, the surface tension of the ink in each perforation of the second meniscus forming member 17 prevents ink from leaking from the intermediate chamber 16 through the joint portion 2 and prevents air from entering from the joint portion into the intermediate chamber 16. In a state that the ink tank 1 is attached to the printer, the surface tension prevents a pressure variation, which arises from vibration, impact and acceleration applied to the ink tank 1, and further blocks the movement of air bubbles from the nozzle side into the printhead 3. The mesh size of the second meniscus forming member 17 is smaller than that of the first meniscus forming member 14, which is provided between the main ink chamber 11 and the intermediate chamber 16, but is nearly equal to that of the filter 22 in the part of the printhead 3 which will be described later.

The outer circumferential surface 18 of the joint portion 2 is flat so that the joint member 21 of the printhead 3 is easily brought into contact with the joint portion 2.

In the ink introducing portion 4, the printhead 3 is coupled with the joint portion 2 of the ink tank 1. The joint member 21 is disposed around the ink introducing portion 4. When the ink tank 1 is attached to the printhead, the joint member 21 comes in contact with the outer circumferential surface 18 and is deformed, to thereby seal the jointing portion. By the sealing, no ink leaks from the jointing portion. The material of the joint member 21 may be silicone rubber, butyl rubber or the like. If necessary, the joint member 21 may be omitted.

The filter 22 is disposed in the ink introducing portion 4. Dust and the like will be stuck onto the ink introducing portion 4 when the ink tank 1 is detached from the printhead, and foreign materials, together with the ink, flows out of the ink tank 1. The filter 22 is provided for preventing the dust, foreign materials and the like from entering the ink passage 23. The meniscus formed in each perforation of the filter 22 holds the ink to prevent the ink from flowing out of the nozzle. The mesh size of the filter 22 is substantially equal to that of the second meniscus forming member 17 in the part of the ink tank 1.

Figure 3:
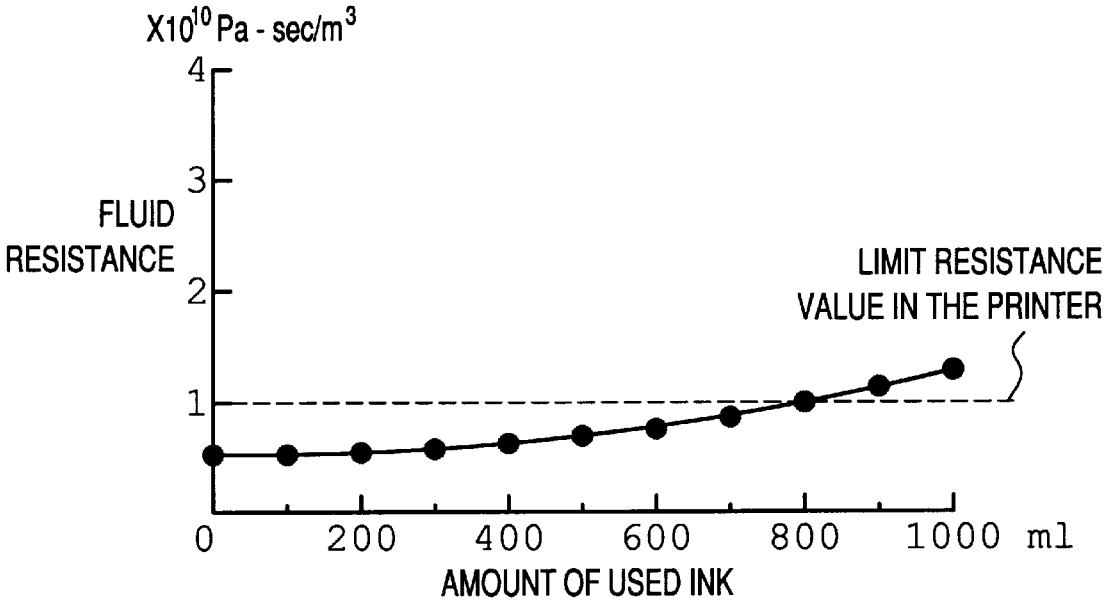
FIG. 3 is a graph showing a variation of fluid resistance value of a filter with respect to the amount of used ink.

FIG. 3 is a graph showing a variation of fluid resistance value of a filter with respect to the amount of used ink in the embodiment of the present invention. In the embodiment, a mat figured cloth of 12 $\mu$m in mesh size was used for the second meniscus forming member 17 and the filter 22. As seen from the graph of FIG. 3, good printing is secured up to 800 ml of the amount of used ink. When comparing the fluid resistance versus used ink amount characteristics of FIGS. 3 and 8, it is seen that the amount of used ink at which the fluid resistance of the ink reaches the limit resistance value in the printer of the present embodiment is approximately two times as large as that in the conventional printer.

Conventional measures taken for preventing the mesh clogging are to carefully wash the parts as foreign material generating sources, to enlarge the area diameter of the filter 22 provided in the part of the printhead 3, and the like. In connection with this, the invention improves the filtering function in a manner that the mesh size of the second meniscus forming member 17 is selected to be substantially equal to that of the filter 22. This measure of the invention succeeds in improving the lifetime and reliability of the printer without greatly changing and modifying the construction of the printer.

The second meniscus forming member 17 and the filter 22 may be formed with the mat figured cloth made of stainless (SUS), ceramic filter, electroforming filter, or the like. The materials of those filters may be selected from among many suitable materials. The material of the second meniscus forming member 17 may be different from that of the filter 22, as a matter of course.

Figure 4:
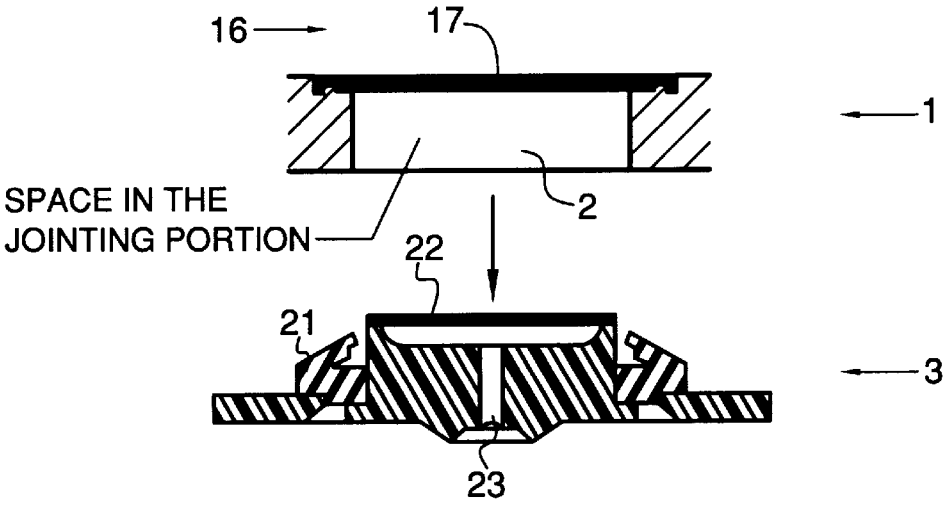
FIG. 4 is an enlarged cross sectional view showing a joint portion and its vicinity in the ink jet printer when an ink tank is removed.
Figure 5:
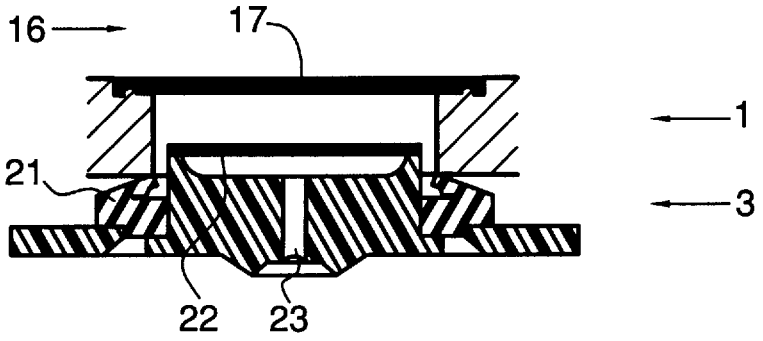
FIG. 5 is an enlarged cross sectional view showing a joint portion and its vicinity in the ink jet printer when an ink tank is attached to a printhead of the printer.

FIG. 4 is an enlarged cross sectional view showing a joint portion and its vicinity in the ink jet printer when an ink tank is removed. FIG. 5 is an enlarged cross sectional view showing a joint portion and its vicinity in the ink jet printer when an ink tank is attached to a printhead of the printer. In those figures, like reference numeral designate like portions in FIG. 1. The ink tank 1 put in a state shown in FIG. 4 is made to approach to the printhead 3, and the joint member 21 disposed around the ink introducing portion 4 comes in contact with the flat surface of the outer circumferential surface 18, which is flat, and is elastically deformed thereon. As a result, the joint portion is hermetically sealed, so that the ink passage extending through the joint portion is isolated from outside air. Through the space closed by the joint portion 2 and the ink introducing portion 4, ink flows from the ink tank 1 to the printhead 3.

The joint member 21 is pressed and deformed when the ink tank 1 is attached to the printhead, and the space of the jointing portion is put at a higher pressure than the atmospheric pressure. At this time, superfluous air left in the jointing portion pushes the second meniscus forming member 17 in the part of the ink tank 1 and the filter 22 of the printhead 3. Usually, air will flow toward the filter whose average open-space diameter is larger. However, in the present invention, the average open-space diameter of the filter 22 in the part of the printhead 3 is substantially equal to that of the second meniscus forming member 17 in the part of the ink tank 1. Therefore, it is estimated that the air flows out of the space in the jointing portion by another cause.

When ink is absent in the part of the printhead 3, the ink meniscuses of the filter 22 of the printhead 3, if formed, are destroyed and the space of the jointing portion is opened to the air because of the high pressure within the space, caused when the ink tank 1 was attached. Therefore, most of the superfluous air flows into the ink tank 1, passes through the ink tank and flows out to the outside. After the superfluous air is discharged outside, no air bubbles are present and hence flow into the ink passage of the printhead 3.

When ink is present in the part of the printhead 3, the pressure exceeds a bubble point pressure at both the second meniscus forming member 17 of the ink tank 1 and the filter 22 in the part of the printhead 3. Therefore, air babbles start to flow into the space of the jointing portion. A bubble flowing rate depends on a fluid resistance of the bubble flowing passage upstream of the space of the jointing portion. Specifically, a fluid resistance in the part of the ink tank 1 is that of the passage ranging to the second meniscus forming member 17 in the part of the ink tank 1. A fluid resistance In the part of the printhead 3 is that of the passage ranging from the filter 22 to the nozzle.

Figure 6A:
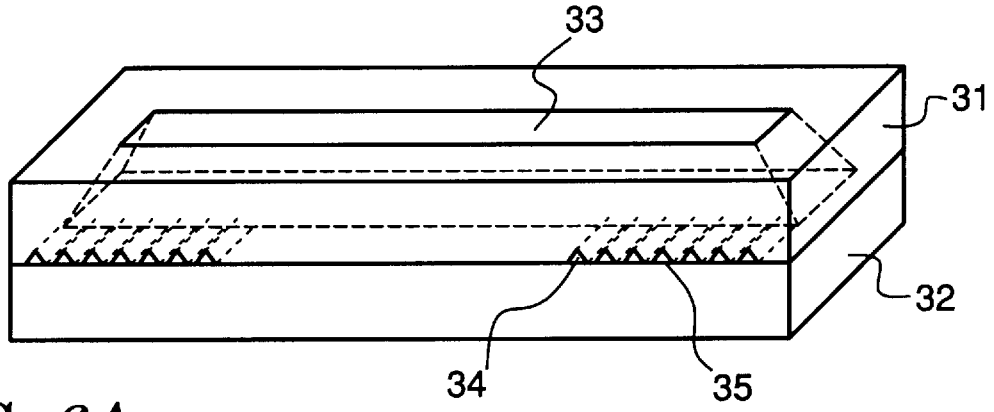
FIGS. 6A and 6B are views showing an example of a head chip.
Figure 6B:
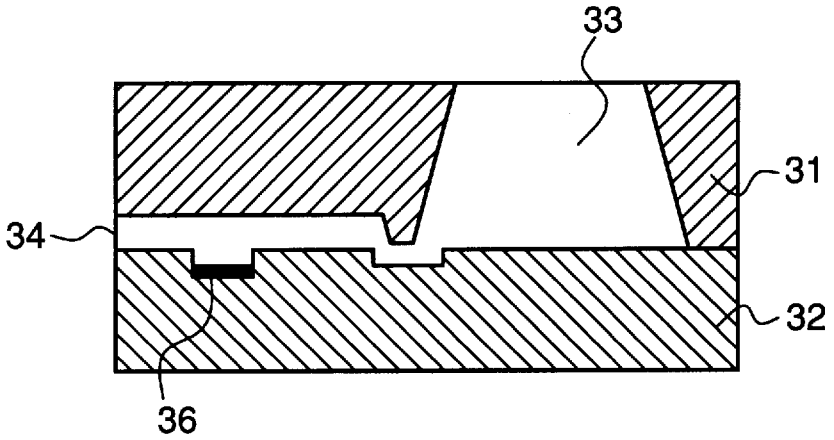

FIG. 6 is a view showing an example of a head chip. FIG. 6A is a perspective view showing the head chip and FIG. 6B is a cross sectional view showing the same. In the figure, reference numeral 31 is a channel substrate; 32 is a heater substrate; 33 is a common liquid chamber; 35 is dummy nozzles; and 36 is heaters. In the printhead 3, ink is introduced from the ink introducing portion 4 provided with the filter 22 to the head chip as shown in FIG. 6, through the ink passage 23. The channel substrate 31 is bonded to the heater substrate 32 to form the head chip shown in FIG. 6. As shown, the channel substrate 31 includes the common liquid chamber 33, nozzles 34, dummy nozzles 35, and the like. In the heater substrate 32, heaters 36 are formed in association with at least the nozzles 34, respectively. The ink is supplied from the ink passage 23 to the common liquid chamber 33 of the head chip, and flows through the nozzles 34 to the dummy nozzles 35. The dummy nozzles 35 are not used for actual printing, but are used for the blank discharging in maintenance or the removal of air bubbles in a suction operation.

In a specific head chip, the nozzles 34 may be 160 nozzles and the dummy nozzles 35 may be 34 nozzles. The cross section of each of the nozzles 34 is an isosceles whose height is approximately 29 $\mu$m and base angles are each approximately 55°. The dummy nozzles 35 are selected to be larger than the nozzles 34, to thereby reduce the fluid resistance and facilitate the removal of air bubbles and dust.

In the case of the head chip having a structure as shown in FIG. 6, the ink passage ranging to the nozzles 34 and the dummy nozzles 35 is crooked in order to efficiently utilize the pressure generated by the heaters 36. A fluid resistance of the head chip is very high because of the thus crooked fluid passage and the sectional area of each nozzle.

In the actual printer manufactured, a fluid resistance in the part of the ink tank 1 and a fluid resistance in the part of the printhead 3 were:

$$R\ (\text{ink tank})=1.6\times10^{9}\ (\text{Pa}\cdot\text{sec/m}^3)$$

$$R\ (\text{printhead})=3.0\times10^{11}\ (\text{Pa}\cdot\text{sec/m}^3)$$

As seen, the fluid resistance of the ink tank 1 is extremely large. Let us consider the behavior of the superfluous air left in the jointing portion between the ink tank 1 and the printhead 3. A rate at which the air bubbles enters the ink in the part of the ink tank 1 (referred to as a bubble entering rate) is at least 100 times as high as a bubble entering rate In the printhead 3. In other words, 99% of the superfluous air flows into the intermediate chamber 16 in the part of the ink tank 1. Therefore, the superfluous air in the jointing portion little flows, in the form of air bubbles, into the ink passage 23 of the printhead 3.

In an actual case, a fluid capacitance and a fluid inductance will act on the bubble entering rate, in addition to the fluid resistance. The fluid capacitance in the part of the ink tank 1 is considerably larger than that in the part of the printhead. The fluid inductance in the part of the printhead 3 is considerably higher than in the part of the ink tank. Therefore, a ratio of the bubble entering rates must be much larger.

As described above, in the invention, an average open-space diameter of the filter 22 in the part of the printhead 3 in selected to be substantially equal to that of the second meniscus forming member 17 in the part of the ink tank 1. This feature suppresses an increase of a pressure loss, which is due to the clogging of the filter 22, and directs the air bubbles generated by attachment of the ink tank 1 to the intermediate chamber 16 of the ink tank 1. The result is to provide a printer of high reliability and long lifetime.

After entering the intermediate chamber 16, air bubbles move toward the upper part of the intermediate chamber 16, and along the slanted upper surface of the intermediate chamber 16, and are finally gathered in the upper space in the intermediate chamber 16, which is located at a position higher than the through-hole. Therefore, there is no chance that the flow of ink in the ink tank 1 is interrupted by the air bubbles which entered the intermediate chamber 16.

To block the entering of foreign materials into the printhead 3, it is desirable to reduce the mesh size of the filter 22 and the second meniscus forming member 17. Where the mesh size of the filter and the meniscus forming member is small, the fluid resistance is increased and approaches to the limit resistance value in the initial stage. After passing through the filter 22, air bubbles and foreign materials reach the head chip as shown in FIG. 6. In this case, those bubbles and foreign materials whose particle diameter is much smaller than the diameter of each nozzle 34 a little interrupt the flow of ink. In a normal printing or a maintenance, the air bubbles and foreign materials are discharged out of the nozzles 34 and the dummy nozzles 35, and hence little affect the printed picture. For this reason, the mesh size of the filter 22 and the second meniscus forming member 17 is appropriately determined in consideration with the whole fluid resistance, the nozzle diameter and other factors.

Figures 7, 8:
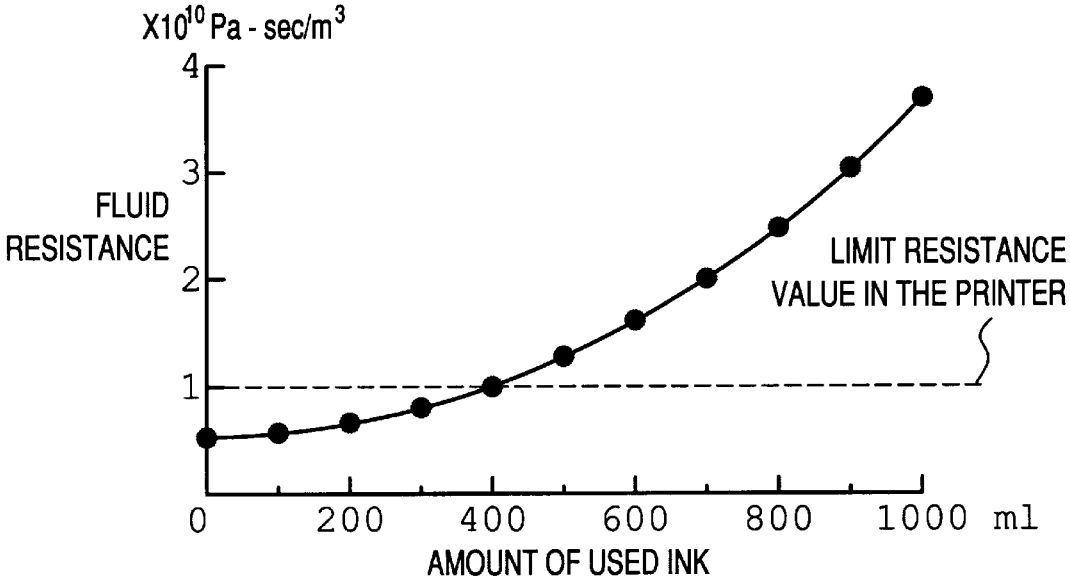
FIG. 7 is a table showing, by way of example, relationships between filtering particle sizes and particle passing efficiencies of filters.
FIG. 8 is a graph showing a variation of fluid resistance of a filter against the amount of used ink.

The mesh size of the filter 22 may be somewhat different from that of the second meniscus forming member 17. Reference is made to FIG. 7. In a stable of FIG. 7, mat figured cloth filters of different mesh sizes of 12 $\mu$m, 13 $\mu$m and 38 $\mu$m are shown. Foreign materials of different particle sizes of 10 $\mu$m, 20 $\mu$m, 30 $\mu$m and 40 $\mu$m are also shown. The table describes those foreign materials that passed through those filters in terms of %. As seen from FIG. 7, in a case where a mat figured cloth of 12 $\mu$s in mesh size is used for the filter 22 is used, the number of foreign materials of 10 $\mu$m that reach the joint portion 2 is reduced to about 55%. In detailed description, an seen from FIG. 7, in a case where a mat figured cloth of 12 $\mu$m in mesh size is used for the filter 22 and a mat figured cloth of 13 $\mu$m in mash size is used for the second meniscus forming member 17, the number of foreign materials of 40 $\mu$m that reach the joint portion 2 is remarkably reduced to about 4% of the number of foreign materials in the conventional case where the mat figured cloth whose mesh size is 38 $\mu$m is used, and the number of foreign materials of 30 $\mu$m that reach the joint portion 2 is also remarkably reduced to about 24% of the same. Those figures teach that a frequency of the occurrence of the clogging of the filter 22 is reduced. Also in this case, the excessive air in the jointing portion is guided to the ink tank 1, and air bubbles moving to the printhead 3 is reduced in number. Therefore, the printed picture little suffers from the picture defect caused by air bubbles.

For confirming the advantages of the ink jet printer of the invention, the second meniscus forming members 17 and the filter 22 were manufactured and assembled into the printer. The amounts of used ink at the limit resistance value, and the limit numbers of prints at different resolutions were measured and evaluated. The results of the measurement and evaluation are shown in FIG. 9. In the measurement, the limit resistance value was $1\times10^{10}$ Pa·sec/m$^3$. The areal diameter of the second meniscus forming member 17 was 5 mm, and that of the filter 22 was 4 mm. The printer was operated in the A4 standard mode corresponding to the coverage of 2.0%. The relationship between the amount of used ink and the resolutions were:

| Resolution | Amount of used ink (ml/sheet of A4) |
|---|---|
| 400 × 400 dpi (1) | 0.029 |
| 400 × 800 dpi (2) | 0.033 |

In the table of FIG. 9, a double circle mark (◎) indicates that the limit numbers of prints at the resolutions at both the resolutions (1) and (2) are much larger than the target limit numbers of prints. A circle mark (○) indicates that the limit numbers of prints exceed the target limit numbers of prints at both the resolutions (1) and (2). A triangle mark (Δ) indicates that the limit number of prints exceeds the target limit number of prints at only the resolution (1). A (X) mark indicates that the limit numbers of prints are below the target limit numbers of prints at both the resolutions (1) and (2).

The open-space diameter of the second meniscus forming member, which is provided in the jointing portion of the ink tank, is selected to be substantially equal to the open-space diameter of the filter, which is provided in the jointing portion of the printhead. With this uniqueness, a printer of the present invention is free from the filter clogging and has a long lifetime. If the open-space diameter of the filter is shorter than the diameter of the nozzle an set forth in aspect 5, there is no fear that the nozzles are clogged with the foreign materials after passing through the filter. The filter may be formed with a mat FIG.d cloth of which the open-space diameter is approximately 12 $\mu$m, as net forth in aspect 6. The second meniscus forming member may be a mat figured cloth filter of SUS, as disclosed in aspect 7.

A fluid resistance of the ink passage ranging from the filter in the part of the printhead to the nozzles of the printhead is larger than that of the ink passage ranging to the second meniscus forming member in the part of the ink tank, as set forth in aspect 2. Air that is left and compressed between the second meniscus forming member when the ink tank is coupled with the printhead, may be led to the second ink chamber of the ink tank by way of the second meniscus forming member, an set forth in aspect 3. Therefore, the picture defect, caused by the entering of air bubbles into the printhead, is reduced in its occurrence frequency. As set forth in aspect 4, the air bubbles are led to the second ink chamber and moves upward along the slanted upper surface of the second ink chamber. Therefore, the flowing of ink within the ink tank is not interrupted by the air bubbles. Thus, the present invention has many advantages.

What is claimed is:

1. An image recording device including an ink tank and a printhead in which ink is supplied from the ink tank to the printhead, and said printhead ejects the received ink in the form of ink drops through nozzles thereof onto a recording medium, to thereby form an image on the recording medium, wherein said ink tank comprising:

a first ink chamber for holding ink therein under a negative pressure, said first ink chamber including an air inlet opened to the air and an ink supplying port for supplying ink;

a first meniscus forming member having a number of perforations, provided in said ink supplying port;

a second ink chamber connected to said ink supplying port and having a joint portion to be communicatively coupled with said printhead;

a second meniscus forming member having a number of perforations and having a mesh size of 5 to 60 microns provided in said joint portion; and said printhead comprising:

a filter for filtering out incoming foreign materials when said filter is coupled with said joint portion of said ink tank, said filter having a mesh size of 10 to 60 microns.

2. The image recording device of claim 1, wherein said ink tank is attachable and detachable, and air that is left and compressed between said second meniscus forming member when said ink tank is coupled with said printhead, is led to said second ink chamber of said ink tank by way of said second meniscus forming member.

3. The image recording device of claim 3, wherein said second ink chamber includes an upper surface slanted upward along which the residual air moves upward in said second ink chamber.

4. The image recording device of claim 1, wherein said second meniscus forming member is a stainless mat figured cloth filter.

* * * * *